US005944309A

United States Patent [19]

Popadiuk et al.

[11] Patent Number: 5,944,309

[45] Date of Patent: Aug. 31, 1999

[54] ILLUMINABLE RAMP ASSEMBLY FOR A PINBALL GAME

[75] Inventors: John A Popadiuk, Bartlett; John W. Skalon, Des Plaines, both of Ill.

[73] Assignee: Williams Electronics Games, Inc., Chicago, Ill.

[21] Appl. No.: 09/103,818

[22] Filed: Jun. 24, 1998

[51] Int. Cl.[6] ..... A63F 7/02

[52] U.S. Cl. ..... 273/121 A; 273/118 A; 273/119 A

[58] Field of Search ..... 273/118 R, 118 A, 273/119 R, 119 A, 121 R, 121 A, 127 R, 127 B, 127 C

[56] References Cited

U.S. PATENT DOCUMENTS

| | | |
|---|---|---|
| 2,058,202 | 10/1936 | Anderson . |
| 2,101,188 | 12/1937 | Orcutt et al. . |
| 2,127,261 | 8/1938 | Kramer et al. . |
| 3,441,279 | 4/1969 | Lally et al. . |
| 4,354,680 | 10/1982 | Kmiec . |
| 4,448,417 | 5/1984 | Clark et al. . |
| 4,606,545 | 8/1986 | Ritchie . |
| 4,848,748 | 7/1989 | Krutsch . |
| 4,861,037 | 8/1989 | Oursler . |
| 4,865,322 | 9/1989 | Krutsch . |
| 4,934,699 | 6/1990 | Kaminkow et al. . |
| 4,968,031 | 11/1990 | Kaminkow et al. . |
| 4,971,324 | 11/1990 | Grabel et al. . |
| 5,002,279 | 3/1991 | Kaminkow et al. . |
| 5,120,058 | 6/1992 | Trudeau et al. . |
| 5,123,647 | 6/1992 | Lawlor et al. . |
| 5,149,094 | 9/1992 | Tastad . |
| 5,158,291 | 10/1992 | Biagi et al. . |
| 5,186,462 | 2/1993 | Biagi et al. . |
| 5,284,342 | 2/1994 | Tanzer et al. . |
| 5,297,793 | 3/1994 | DeMar et al. . |
| 5,326,103 | 7/1994 | Lund et al. . |
| 5,332,217 | 7/1994 | Gottlieb . |
| 5,333,866 | 8/1994 | Tanzer et al. . |
| 5,335,910 | 8/1994 | Tanzer et al. . |
| 5,350,174 | 9/1994 | Ritchie et al. . |
| 5,356,141 | 10/1994 | Oursler et al. . |
| 5,356,142 | 10/1994 | Borg et al. . |
| 5,375,829 | 12/1994 | Lawlor et al. . |
| 5,405,144 | 4/1995 | Ritchie et al. . |
| 5,417,422 | 5/1995 | Hansen . |
| 5,417,423 | 5/1995 | Oursler et al. . |
| 5,452,894 | 9/1995 | Hansen . |
| 5,480,149 | 1/1996 | Trudeau . |
| 5,507,488 | 4/1996 | Eddy et al. . |
| 5,516,103 | 5/1996 | Lawlor et al. . |
| 5,533,726 | 7/1996 | Nordman et al. . |
| 5,632,482 | 5/1997 | Anghelo . |
| 5,664,777 | 9/1997 | Nordman et al. . |

FOREIGN PATENT DOCUMENTS

| | | |
|---|---|---|
| 484429 | 7/1952 | Canada . |

*Primary Examiner*—Raleigh W. Chiu
*Attorney, Agent, or Firm*—Arnold White & Durkee

[57] ABSTRACT

An illuminable ramp assembly for a pinball game having a playfield supporting a rolling ball thereon comprises an elongated molded plastic housing and a ball ramp extending alongside the housing. The housing encloses a power supply, a gas tube, protective end caps, and cushioning supports. The gas tube is powered by the power supply. To effectively suspend the gas tube within the housing and, at the same time, provide the gas tube with shock resistance, the protective end caps are mounted over opposing ends of the gas tube, and the cushioning supports are intermittently located along the length of the gas tube. The cushioning supports partially encompass the gas tube and are interposed between the gas tube and the housing. The ball ramp includes an entry end and an exit end. A switch capable of detecting the presence of the rolling ball is preferably located near the entry end of the ball ramp. In response to the rolling ball being delivered to the ball ramp via its entry end such that the rolling ball actuates the switch, a game controller causes the power supply to illuminate the gas tube with an illumination pattern.

30 Claims, 4 Drawing Sheets

ILLUMINABLE RAMP ASSEMBLY FOR A PINBALL GAME

FIELD OF THE INVENTION

The present invention relates generally to pinball games and, more particularly, relates to an illuminable ramp assembly for a pinball game.

BACKGROUND OF THE INVENTION

Pinball games generally include an inclined playfield housed within a game cabinet and supporting a rolling ball (i.e., pinball). A plurality of play features are arranged on the playfield. A game player uses a pair of mechanical flippers mounted at one end of the playfield to propel the rolling ball at the various play features on the playfield to score points and control the play of the game. The success of a manufacturer's line of pinball games depends, in part, on its ability to attract players to its games with new and exciting play features. The present invention provides such a new and exciting play feature.

SUMMARY OF THE INVENTION

Specifically, the present invention provides an illuminable ramp assembly for a pinball game having an inclined playfield housed within a game cabinet and supporting a rolling ball thereon. The illuminable ramp assembly comprises an elongated molded plastic housing and a ball ramp extending alongside the housing. The housing encloses a power supply, a gas tube, protective end caps, and cushioning supports. The gas tube is powered by the power supply. To effectively suspend the gas tube within the housing and, at the same time, provide the gas tube with shock resistance, the protective end caps are mounted over opposing ends of the gas tube, and the cushioning supports are intermittently located along the length of the gas tube. The cushioning supports partially encompass the gas tube and are interposed between the gas tube and the housing.

The ball ramp includes an entry end and an exit end. A switch capable of detecting the presence of the rolling ball is preferably located near the entry end of the ball ramp. In response to the rolling ball being delivered to the ball ramp via its entry end such that the rolling ball actuates the switch, a game controller causes the power supply to illuminate the gas tube with an illumination pattern.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
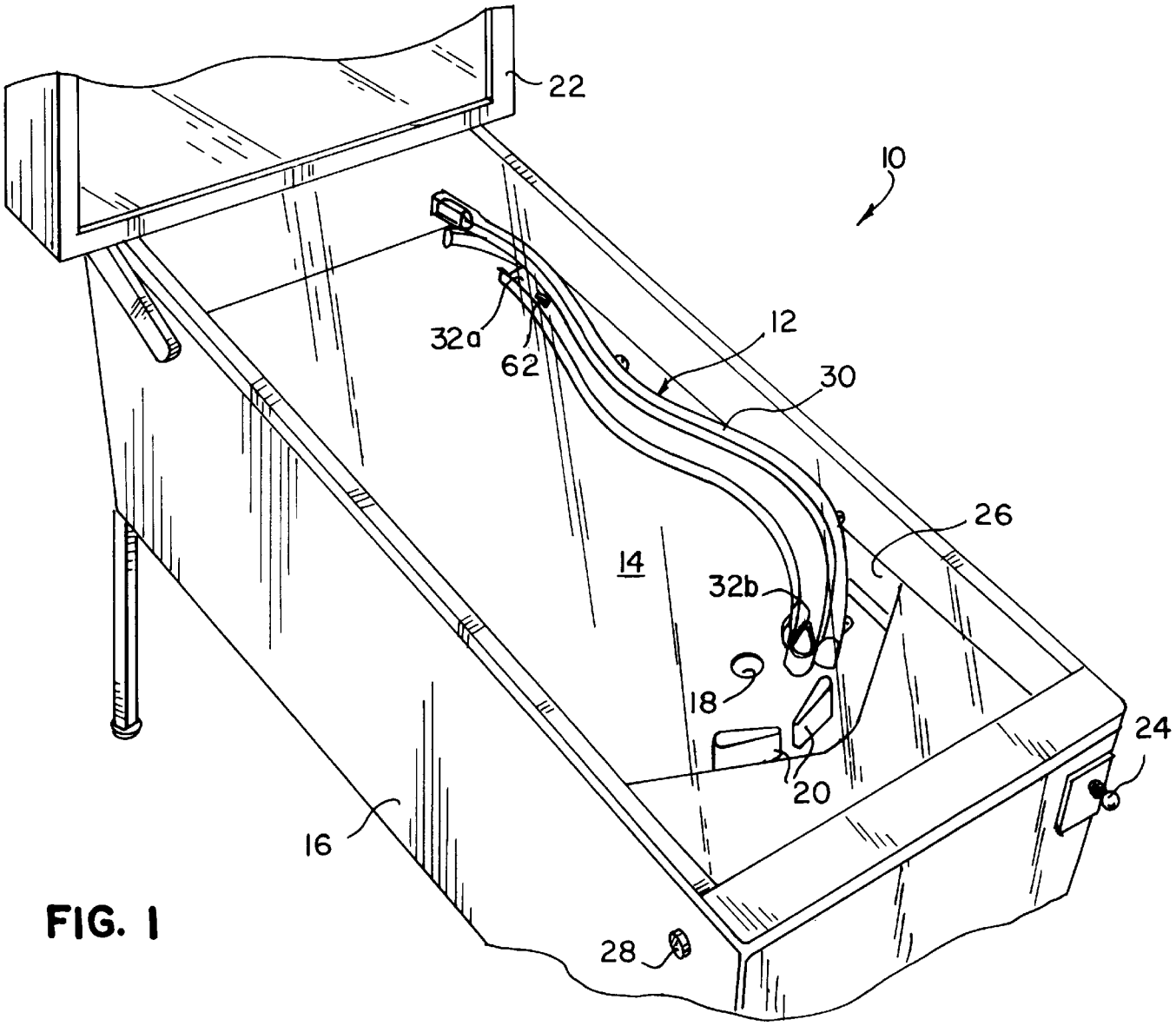
FIG. 1 is a perspective view of a pinball game including an illuminable ramp assembly embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 depicts a pinball game 10 including an illuminable ramp assembly 12 embodying the present invention. The pinball game 10 includes an inclined playfield 14 housed within a game cabinet 16 and supporting a rolling ferromagnetic ball 18 thereon. The rolling ball 18 can be propelled across the playfield 14 by a pair of player-operated flippers 20. A vertical backbox 22 houses a game controller (FIG. 6) and other electronics for controlling play of the game. A player manipulates a plunger 24 to shoot the rolling ball 18 up an alley 26 onto the playfield 14. When the rolling ball 18 approaches the flippers 20, the player presses flipper switches 28 to activate the flippers 20 and thereby propel the rolling ball 18 toward play features on the playfield 14. In practice, the playfield 14 incorporates a number of playfield features. FIG. 1 shows only the illuminable ramp assembly 12 for clarity.

Figure 2:
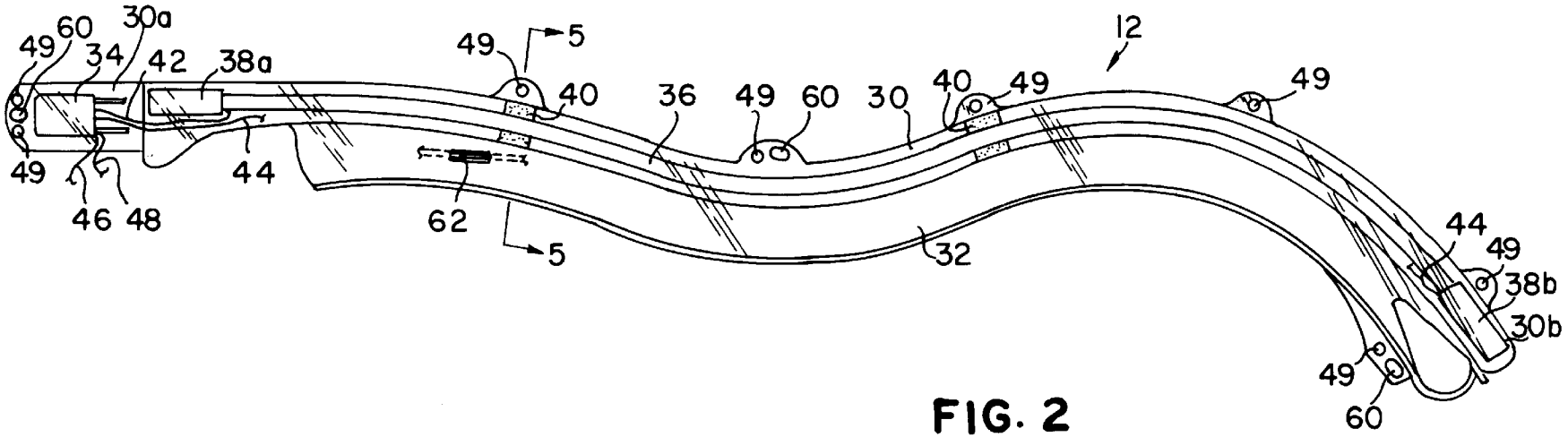
FIG. 2 is a top view of the illuminable ramp assembly.
Figure 3:
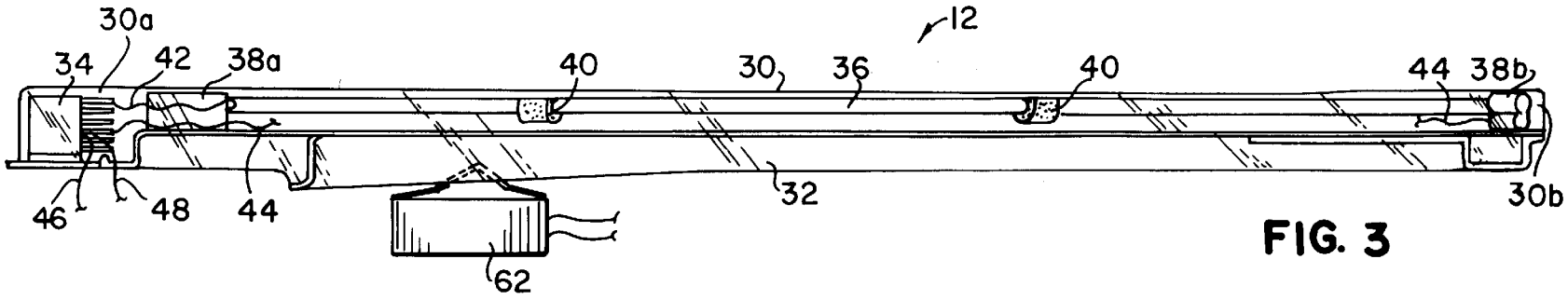
FIG. 3 is a side view of the illuminable ramp assembly.
Figure 4:
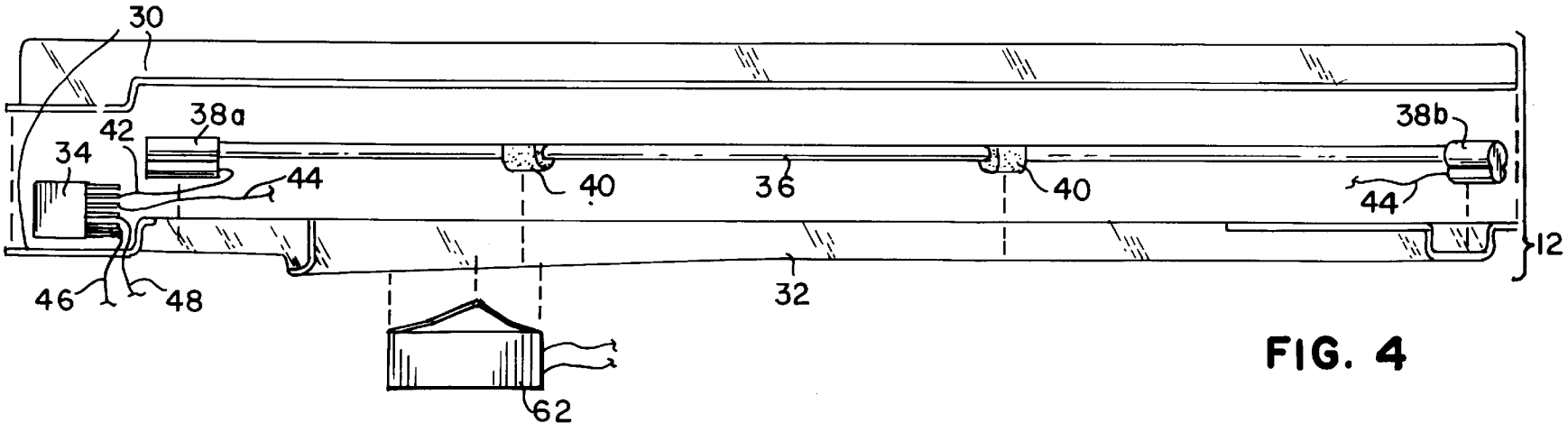
FIG. 4 is an exploded side view of the ramp assembly.

Referring now to FIGS. 2–4, the illuminable ramp assembly 12 comprises an elongated housing 30 and a ball ramp 32 extending alongside the housing 30. Both the housing 30 and the ball ramp 32 are preferably composed of a substantially transparent molded plastic such as polyethylene terephthalate (PET) that is resistant to torsional and flexural stresses. The housing 30 encloses a high voltage transformer 34, a gas tube 36, a pair of protective end caps 38*a–b*, and cushioning supports 40.

The tube 36 carries a gas containing a large proportion of neon of a desired color so that the gas tube 36 is illuminated in response to activation by the transformer 34. The color of the neon can be varied from one pinball game to the next so that pinball games in the same product line have gas tubes that are illuminated in different colors.

The housing 30 includes a distal end 30*a* located away from the player and a proximal end 30*b* located near the player. To keep the transformer 34 substantially hidden from view, the transformer 34 is preferably located in an enlarged compartment at the distal end 30*a* of the housing 30. The transformer 34 is electrically connected to the gas tube 36 by a supply wire 42 and a return wire 44. The supply wire 42 extends between the transformer 34 and one end of the gas tube 36, while the return wire 44 extends between the transformer 34 and the other end of the gas tube 36. To activate the transformer 34 and thereby illuminate the gas tube 36, a required input voltage is applied to the transformer 34 along an input wire 46. The other input wire 48 is electrically connected to ground. The transformer 34 is preferably implemented with a gas tube power supply requiring an input of up to 12 Volts DC and generating an output of up to 1500 Volts at approximately 5 milliAmps. Such a power supply is commercially available as Model No. VT12D5 from Ventex Technology, Inc. of Riviera Beach, Fla.

To effectively suspend the gas tube 36 within the housing 30 and, at the same time, provide the gas tube 36 with shock resistance, the protective end caps 38*a–b* are mounted over opposing ends of the gas tube 36, and the cushioning supports 40 are intermittently located along the length of the gas tube 36. Each of the protective end caps 38*a–b* preferably forms a pair of cylindrical cavities—one for receiving the associated end of the gas tube 36 and the other for receiving the associated electrical wire 42 or 44 extending from the transformer 34. The pair of cavities within each protective end cap are open to each other within the end cap. The distal end cap 38*a* receives the supply wire 42 which, in turn, is electrically connected to one end of the gas tube 36 within the distal end cap 38*a*. Likewise, the proximal end cap 38*b* receives the return wire 44 which, in turn, is electrically connected to the other end of the gas tube 36 within the proximal end cap 38*b*. The protective end caps 38*a–b* are preferably composed of a silicon-based insulative material. Enclosing the uninsulated ends of the supply and return wires 42 and 44 within the respective end caps 38*a* and 38*b* and enclosing these wires and the transformer 34 within the distal end the housing 30 deters players from attempting to contact these high voltage elements and is therefore advantageous for safety reasons.

Figure 5:
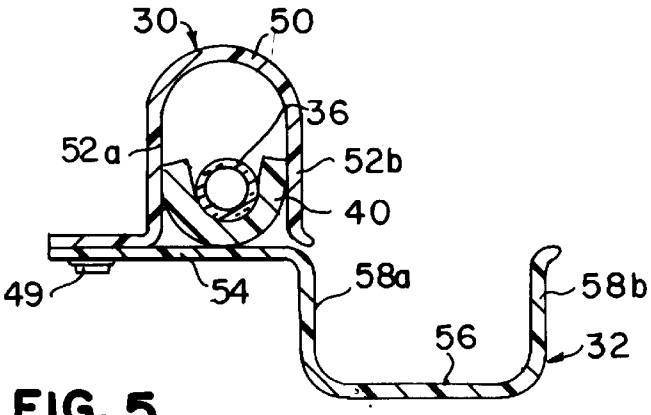
FIG. 5 is a section view taken generally along line 5—5 in FIG. 2.

As best shown in FIG. 5, the semi-cylindrical cushioning support 40 partially encompasses the gas tube 36 and is interposed between the gas tube 36 and the housing 30. To absorb any downward shocks, a portion of the cushioning support 40 is positioned beneath the gas tube 36. In a preferred embodiment, a pair of cushioning supports 40 are spaced from the opposing ends of the gas tube 36 and are spaced from each other. The number of cushioning supports 40 utilized is dependent upon the length of the gas tube 36; as the length of the gas tube 36 is increased, it may be desirable to increase the number of cushioning supports 40. The cushioning supports 40 are preferably composed of flexible polystyrene foam having a thickness of approximately 0.25 inch.

Still referring to FIG. 5, the housing 30 and the ball ramp 32 are formed by a pair of molded plastic members. Specifically, a first molded plastic member provides the housing 30 with a curved top wall 50 and a pair of opposing side walls 52*a–b*. A second molded plastic member provides the housing 30 with a bottom wall 54 and provides the ball ramp 32 with a bottom wall 56 and a pair of opposing side walls 58*a–b*. Except for the curved top wall 50 of the housing 30, the remaining walls referenced above are generally planar. The side wall 52*b* of the housing 30 is aligned with the side wall 58*a* of the ball ramp 32. To minimize any shocks created by a rolling ball 18 (FIG. 1) on the gas tube 36 as the rolling ball traverses the ball ramp 32, the bottom wall 56 of the ball ramp 32 is preferably positioned below the level of the bottom wall 54 of the housing 30 by an amount sufficient such that the rolling ball 18 does not impact the housing side wall 52*b* when it is on the ball ramp 32. The pair of molded plastic members depicted in FIG. 5 are fastened to each other by rivets 49 at intermittent locations along the illuminable ramp assembly 12. The locations of these rivets 49 along the length of the assembly are best shown in FIG. 2.

Referring to FIG. 2, the illuminable ramp assembly 12 is preferably connected to the playfield 14 by conventional mounting brackets intermittently located along the length of the assembly. The mounting brackets extend between the assembly 12 and the playfield 14. In a preferred embodiment, there are three mounting brackets—a first located at a distal end of the assembly 12, a second located at a proximal end of the assembly 12, and a third located approximately midway between the distal and proximal ends of the assembly 12. Holes for receiving the mounting brackets are designated by the reference numeral 60 in FIG. 2.

Referring to FIG. 1, the ball ramp 32 includes a distal entry end 32*a* and a proximal exit end 32*b*. A game player uses the flippers 20 to propel the rolling ball 18 across the playfield 14 so that the rolling ball 18 is directly or indirectly delivered to the entry end 32*a* of the ball ramp 32. In the illustrated pinball game, the entry end 32*a* of the ball ramp 32 is elevated above the upper surface of the playfield 14. Therefore, the rolling ball 18 propelled from the flippers 20 must be redirected to the entry end 32*a* by another play feature such as a ball elevator or another ramp. It is, however, contemplated that the ball ramp 32 could be arranged to directly receive the propelled rolling ball 18 without any redirection provided by an intervening play feature.

Once the rolling ball 18 is on the ball ramp 32, the rolling ball 18 is carried by momentum and gravity from the entry end 32*a* to the exit end 32*b* of the ball ramp 32. A switch 62 capable of detecting the presence of the rolling ball 18 is preferably located near the entry end 32*a* of the ball ramp 32. The switch 62 is preferably in the form of a rollover microswitch as best shown in FIGS. 3 and 4, but alternatively may be in the form of any other switch capable of sensing the rolling ball 18, including but limited to an optical switch and a proximity switch.

Figure 6:
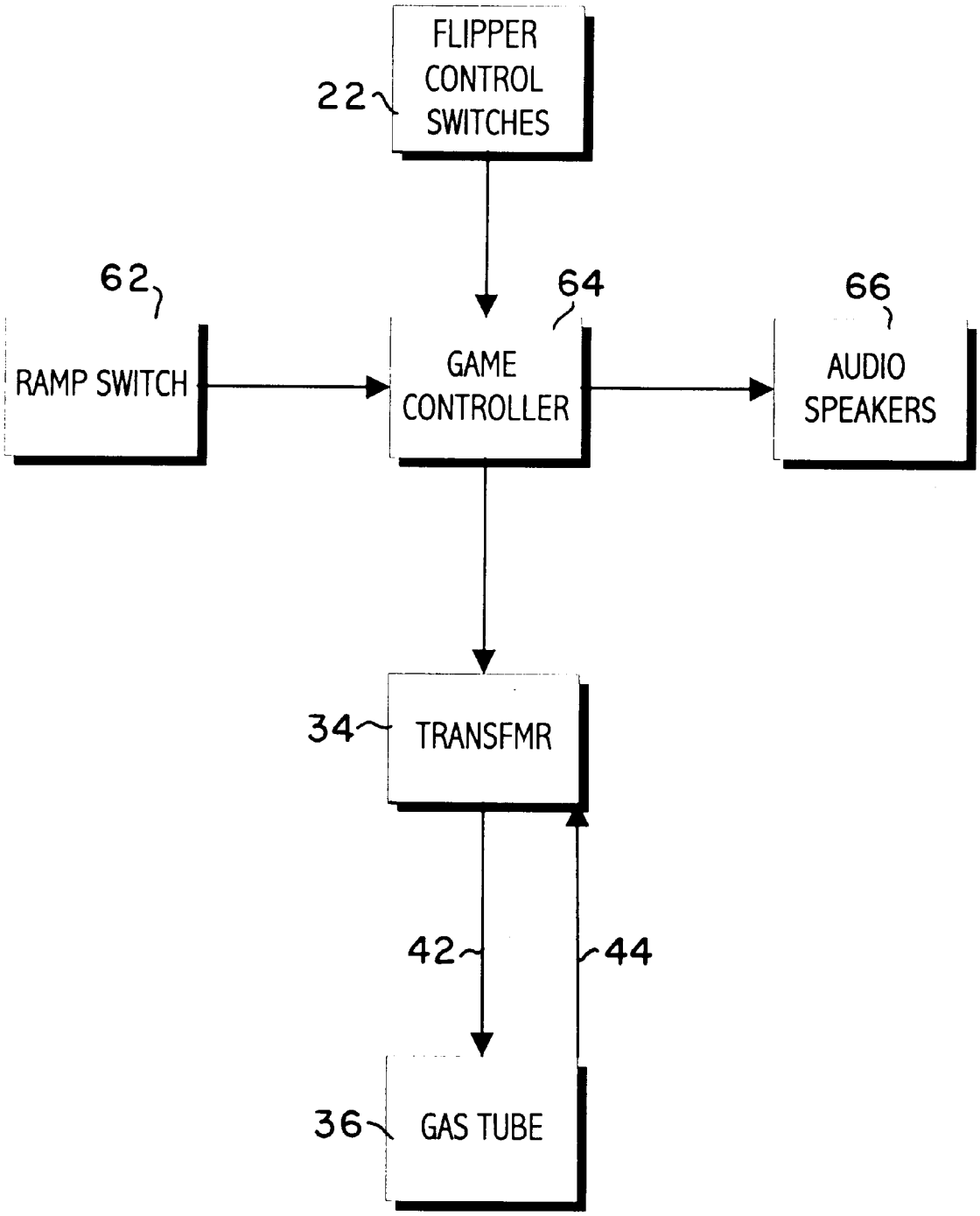
FIG. 6 is a block diagram showing the electrical connections between the illuminable ramp assembly and the game microprocessor.

FIG. 6 illustrates the electrical connections between the illuminable ramp assembly 12 and the game controller 64. In response to the rolling ball 18 entering the ball ramp 32 via its entry end 32*a* and rolling over the switch 62 discussed above in connection with FIG. 1, the switch 62 sends a signal to the game controller 64 to activate the transformer 34. In accordance with the game program, the game controller 64 can regulate the input voltage applied to the transformer 34 to vary the frequency and intensity of illumination of the gas tube 36, thereby creating a plurality of illumination patterns. The particular illumination pattern that is generated may be randomly selected by the game controller 64 or may be dependent upon the game situation. For example, the gas tube 36 can turn "on" and "off" a single time or can repeatedly turn "on" and "off" several times at a rapid or slow rate. By changing the preferred transformer 34 to a different model, the gas tube 36 can gradually illuminate from its distal end to its proximal end to follow the rolling ball 18 as it traverses the ball ramp 32. In conjunction with the creation of an illumination pattern, the game controller 64 can generate appropriate sound patterns through audio speakers 66.

While the present invention has been described with reference to one or more particular embodiments, those skilled in the art will recognize that many changes may be made thereto without departing from the spirit and scope of the present invention. For example, the use of the illuminable ramp assembly 12 is not limited to game play. Rather, the game controller can cause the gas tube 36 to generate illumination patterns during the "attract" mode of the pinball game when the rolling ball is not in play. In another embodiment, the ball detecting switch 62 is located just upstream relative to the entry end 32*a* of the ball ramp 32. If desired, the game controller can then be programmed to delay the generation of any illumination pattern until the rolling ball actually enters the ball ramp 32. Each of these embodiments and obvious variations thereof is contemplated as falling within the spirit and scope of the claimed invention, which is set forth in the following claims.

What is claimed is:

1. An illuminable ramp assembly for a pinball game having a playfield supporting a rolling ball thereon, said assembly to be mounted to said playfield, said assembly comprising:

an elongated housing enclosing a power supply, a gas tube, a pair of protective end caps, and cushioning supports, said gas tube extending along at least a portion of a length of said housing, said protective end caps being mounted over respective opposing ends of said gas tube, said cushioning supports being intermittently located along a length of said gas tube, each of said cushioning supports partially encompassing said gas tube and being interposed between said gas tube and said housing, said power supply being electrically connected to said gas tube so as to illuminate said gas tube in response to activation of said power supply; and a ball ramp extending alongside said housing and adapted to support said rolling ball thereon.

2. The assembly of claim 1, wherein said power supply is electrically connected to said gas tube by a supply wire and a return wire, said supply wire extending between said power supply and one of said opposing ends of said gas tube, said return wire extending between said power supply and the other of said opposing ends of said gas tube.

3. The assembly of claim 2, wherein each of said protective end caps forms a pair of cavities, one of said cavities receiving a respective one of said opposing ends of said gas tube, the other of said cavities receiving a respective one of said supply and return wires, an end of said respective one of said supply and return wires being electrically connected to said respective one of said opposing ends of said gas tube within said respective end cap.

4. The assembly of claim 1, wherein said protective end caps are composed of an insulative material.

5. The assembly of claim 1, wherein said cushioning supports are composed of flexible polystyrene foam.

6. The assembly of claim 1, wherein said cushioning supports are partially located beneath said gas tube.

7. The assembly of claim 1, wherein said gas tube carries neon gas.

8. The assembly of claim 1, further including a switch arranged to detect the presence of said rolling ball when said rolling ball is in close proximity to said ball ramp.

9. The assembly of claim 8, wherein said ball ramp includes an entry end and an exit end, said switch being arranged to detect the presence of said rolling ball when said rolling ball is on said ball ramp, said switch being located near said entry end of said ball ramp.

10. The assembly of claim 8, wherein said switch and said power supply are electrically connected to a game controller, said game controller causing said power supply to illuminate said gas tube in response to said rolling ball actuating said switch.

11. The assembly of claim 1, wherein said ball ramp includes a ball supporting wall for supporting said rolling ball thereon and spaced from said housing by a sufficient amount that said rolling ball is free of contact with said housing when said rolling ball is on said ball ramp.

12. The assembly of claim 11, wherein ball ramp includes a bottom wall serving as said ball supporting wall, said bottom wall being positioned at a level below said housing.

13. The assembly of claim 1, wherein said ball ramp includes a first bottom wall and a first pair of opposing side walls extending upward from said bottom wall, said first bottom wall adapted to support said rolling ball thereon, and wherein said housing includes a second bottom wall and a second pair of opposing side walls extending upward from said second bottom wall, one of said first pair of side walls being aligned with one of said second pair of side walls, said first bottom wall being positioned below a level of said second bottom wall by an amount sufficient that said rolling ball is free of contact with said one of said second pair of side walls when said rolling ball is on said ball ramp.

14. An illuminable ramp assembly for a pinball game having a playfield supporting a rolling ball thereon, said assembly to be mounted to said playfield, said assembly comprising:

a housing enclosing a power supply and a gas tube, said gas tube extending along at least a portion of a length of said housing, said power supply being electrically connected to said gas tube so as to illuminate said gas tube in response to activation of said power supply;

means, located within said housing, for suspending said gas tube within said housing; and means, extending alongside said housing, for supporting said rolling ball thereon.

15. The assembly of claim 14, wherein said suspending means includes a pair of insulative end caps mounted over respective opposing ends of said gas tube.

16. The assembly of claim 14, wherein said suspending means includes cushioning supports intermittently located along a length of said gas tube, each of said cushioning supports partially encompassing said gas tube and being interposed between said gas tube and said housing.

17. The assembly of claim 14, wherein said supporting means includes a ball ramp.

18. The assembly of claim 17, wherein said ball ramp includes an entry end and an IS exit end, and further including a switch arranged to detect the presence of said rolling ball and located near said entry end of said ball ramp.

19. The assembly of claim 18, wherein said switch and said power supply are electrically connected to a game controller, said game controller causing said power supply to illuminate said gas tube in response to said rolling ball actuating said switch.

20. The assembly of claim 17, wherein said ball ramp includes a ball supporting wall for supporting said rolling ball thereon and spaced from said housing by a sufficient amount that said rolling ball is free of contact with said housing when said rolling ball is on said ball ramp.

21. The assembly of claim 17, wherein said ball ramp includes a first bottom wall and a first pair of opposing side walls extending upward from said bottom wall, said first bottom wall adapted to support said rolling ball thereon, and wherein said housing includes a second bottom wall and a second pair of opposing side walls extending upward from said second bottom wall, one of said first pair of side walls being aligned with one of said second pair of side walls, said first bottom wall being positioned below a level of said second bottom wall by an amount sufficient that said rolling ball is free of contact with said one of said second pair of side walls when said rolling ball is on said ball ramp.

22. The assembly of claim 15, wherein said power supply is electrically connected to said gas tube by a supply wire and a return wire, said supply wire extending between said power supply and one of said opposing ends of said gas tube, said return wire extending between said power supply and the other of said opposing ends of said gas tube.

23. The assembly of claim 22, wherein each of said end caps forms a pair of cavities, one of said cavities receiving a respective one of said opposing ends of said gas tube, the other of said cavities receiving a respective one of said supply and return wires, an end of said respective one of said supply and return wires being electrically connected to said respective one of said opposing ends of said gas tube within said respective end cap.

24. The assembly of claim 14, wherein said gas tube carries neon gas.

25. A play feature for a pinball game having a playfield supporting a rolling ball thereon, said play feature comprising:

means for enclosing a power supply and a gas tube, said power supply being electrically connected to said gas tube so as to illuminate said gas tube in response to activation of said power supply;

means, located within said enclosing means, for suspending said gas tube within said enclosing means; and guide means, extending alongside said enclosing means, for supporting said rolling ball thereon such that said rolling ball is free of contact with said enclosing means.

26. The play feature of claim 25, further including:

means, located in close proximity to said guide means, for detecting the presence of said rolling ball; and game control means, coupled to said detecting means and said power supply means, for causing said power supply to illuminate said gas tube in response to detection of said rolling ball by said detecting means.

27. The play feature of claim 26, wherein said detecting means includes a switch located near an entry end of said guide means.

28. The play feature of claim 25, wherein said enclosing means includes an elongated molded plastic housing.

29. The play feature of claim 25, wherein said suspending means includes protective end caps mounted over opposing ends of said gas tube and cushioning supports interposed between said gas tube and a wall of said enclosing means, said cushioning supports being intermittently located along a length of said gas tube.

30. The play feature of claim 25, wherein said guide means includes a ball ramp.

* * * * *

UNITED STATES PATENT AND TRADEMARK OFFICE

CERTIFICATE OF CORRECTION

PATENT NO.: 5,944,309

DATED: August 31, 1999

INVENTOR(S): Popadiuk et al.

It is certified that errors appear in the above-identified patent, and that said Letters Patent is hereby corrected as shown below.

Column 6, Claim 18, line 32, delete "IS"

Signed and Sealed this

Twenty-fifth Day of April, 2000

*Attest:*

Q. TODD DICKINSON

*Attesting Officer*

*Director of Patents and Trademarks*